US010451238B2

(12) United States Patent
Meyrenaud et al.

(10) Patent No.: US 10,451,238 B2
(45) Date of Patent: Oct. 22, 2019

(54) VEHICLE LIGHT MODULE COMPATIBLE WITH DRIVING ON THE LEFT AND DRIVING ON THE RIGHT

(71) Applicant: VALEO VISION, Bobigny (FR)

(72) Inventors: Jean-Luc Meyrenaud, Livry Gargan (FR); Paul Racine, Besancon (FR); Benoit Reiss, Magency (FR)

(73) Assignee: VALEO VISION, Bobigny (FR)

( * ) Notice: Subject to any disclaimer, the term of this patent is extended or adjusted under 35 U.S.C. 154(b) by 136 days.

(21) Appl. No.: 15/548,927

(22) PCT Filed: Feb. 4, 2016

(86) PCT No.: PCT/EP2016/052440
§ 371 (c)(1),
(2) Date: Aug. 4, 2017

(87) PCT Pub. No.: WO2016/124718
PCT Pub. Date: Aug. 11, 2016

(65) Prior Publication Data

US 2018/0031199 A1 Feb. 1, 2018

(30) Foreign Application Priority Data

Feb. 5, 2015 (FR) ..... 15 50888

(51) Int. Cl.
*F21S 41/265* (2018.01)
*F21S 41/19* (2018.01)
(Continued)

(52) U.S. Cl.
CPC ..... *F21S 41/265* (2018.01); *F21S 41/143* (2018.01); *F21S 41/147* (2018.01); *F21S 41/19* (2018.01);
(Continued)

(58) Field of Classification Search
CPC ..... F21S 41/62; F21S 41/60; F21S 41/265; F21S 41/657
See application file for complete search history.

(56) References Cited

U.S. PATENT DOCUMENTS

2004/0196663 A1 10/2004 Ishida et al.
2009/0080210 A1 3/2009 Reiners et al.
(Continued)

FOREIGN PATENT DOCUMENTS

DE 102005014754 A1 10/2006
EP 1213178 A2 6/2002
(Continued)

OTHER PUBLICATIONS

Machine translation of Huhn et al., EP 2434204A2, published Mar. 28, 2012 (Year: 2012).*
(Continued)

*Primary Examiner* — William N Harris
(74) *Attorney, Agent, or Firm* — Oblon, McClelland, Maier & Neustadt, L.L.P.

(57) ABSTRACT

The invention relates to a light module for a motor vehicle comprising an optical element intended to generate a beam with a partly oblique cut-off, the optical element comprising at least one optical portion having an optical axis, and at least one light source configured to cooperate with said portion intended to generate at least the part of the beam comprising the oblique cut-off. The optical module comprises at least two distinct positions for arranging the light source, the light source occupying one of the two positions, each of the positions being defined on either side of the optical axis of the optical portion so as to generate a beam with oblique cut-off to the right in the first position and a beam with oblique cut-off to the left in the second position.

20 Claims, 6 Drawing Sheets

(51) Int. Cl.

| | |
|---|---|
| ***F21S 41/143*** | (2018.01) |
| ***F21S 41/29*** | (2018.01) |
| ***F21S 41/27*** | (2018.01) |
| ***F21S 41/62*** | (2018.01) |
| ***F21S 41/657*** | (2018.01) |
| ***F21S 41/147*** | (2018.01) |
| ***F21S 41/60*** | (2018.01) |
| ***F21Y 115/10*** | (2016.01) |

(52) U.S. Cl.
CPC ..... *F21S 41/27* (2018.01); *F21S 41/295* (2018.01); *F21S 41/60* (2018.01); *F21S 41/62* (2018.01); *F21S 41/657* (2018.01); *F21Y 2115/10* (2016.08)

(56) References Cited

U.S. PATENT DOCUMENTS

2010/0046242 A1* 2/2010 Lambert ..... B60Q 1/0041 362/509
2010/0195342 A1* 8/2010 Lambert ..... G02B 6/0096 362/511
2013/0223088 A1* 8/2013 Lambert ..... G02B 6/0096 362/511
2014/0104864 A1* 4/2014 Brendle ..... F21S 41/147 362/516
2014/0175978 A1* 6/2014 Kobayashi ..... B60Q 1/1423 315/82
2014/0233254 A1 8/2014 Meyrenaud
2014/0362600 A1* 12/2014 Suckling ..... F21S 41/663 362/583
2015/0241616 A1* 8/2015 Bungenstock ..... G02B 6/0021 362/511
2016/0102831 A1* 4/2016 Okubo ..... F21S 41/19 362/512

FOREIGN PATENT DOCUMENTS

| | | | |
|---|---|---|---|
| EP | 1213178 | A3 | 6/2002 |
| EP | 2434204 | A2 | 3/2012 |
| EP | 2434204 | A3 | 3/2012 |
| EP | 2770246 | A1 | 8/2014 |
| FR | 2853395 | A1 | 10/2004 |

OTHER PUBLICATIONS

International Search Report dated May 11, 2016, in PCT/EP2016/052440, filed Feb. 4, 2016.
French Search Report dated Dec. 3, 2015, in French Patent Application No. 1550888, filed Feb. 5, 2015.

* cited by examiner

VEHICLE LIGHT MODULE COMPATIBLE WITH DRIVING ON THE LEFT AND DRIVING ON THE RIGHT

The present invention relates to a light module for a headlight of a motor vehicle comprising at least one light source and an optical element intended to generate a light beam with a partly oblique cut-off; in particular, this optical element can be used to generate a beam with an oblique cut-off to the left or to the right depending on the type of regulation to which the vehicle is subject.

Vehicle lighting systems are subject to different types of regulation depending on the country in which the vehicle is registered. In particular, in countries where traffic drives on the right side of the roadway (traffic driving on the right), the cut-off of the lighting of the low beams, or code beam, is raised to the right to 15° in order to illuminate the traffic signs and the sidewalks or verges. Conversely, in countries where traffic drives on the left side of the roadway (traffic driving on the left), as in the United Kingdom, the cut-off of the code beam is raised to the left.

In the case of a module with simple structure, the compatibility between traffic driving on the right and traffic driving on the left can be resolved by the addition of another specific module if that does not involve an excessive cost. In the case of a more complex module, the cost of the duplication can become prohibitive.

Different vehicle lighting systems that can be adapted to traffic driving on the left and on the right do exist. In particular, the patent application US 2008/0002420 A1 describes a system that can be configured according to the regulation of the country. The headlight, intended to generate the desired configuration, can comprise two different modules with opposite inclinations. These two modules are then selectively illuminated to generate the configuration corresponding to the regulation of the country. The headlight can also comprise only a single module, this module then being mobile. It is sufficient to turn it to the required inclination. This mobile mechanism is driven by a controller.

These two configuration changing embodiments are not optimized, either in terms of bulk or in terms of cost. The first example requires two modules, only one being used at a time. The second example requires a controller.

There is therefore a need to have an optical module which is compatible with both traffic driving on the right and with traffic driving on the left and which makes it possible to mitigate the above drawbacks.

The invention proposes a light module for motor vehicle comprising an optical element intended to generate a beam with a partly oblique cut-off, the optical element comprising at least one optical portion having an optical axis, and at least one light source configured to cooperate with said portion, characterized in that the optical module comprises at least two distinct positions to have a light source intended to generate at least the part of the beam comprising the optical cut-off, the light source occupying one of the two positions, each of the positions being defined on either side of the optical axis of the optical portion so as to generate a beam with optical cut-off to the right in the first position and a beam with optical cut-off to the left in the second position.

In this way, the same optical module can be used for traffic driving on the left and for traffic driving on the right. Consequently, the headlight manufacturer now only has to design a single optical element, with single manufacturing toolages (molds for example), making it possible to manufacture a single optical module compatible with the different types of traffic. The beam advantageously includes at least one horizontal cut-off portion followed by an oblique cut-off portion, notably inclined by an angle of 15° or of 45°. Also, the light module according to the invention can be a lighting and/or signaling module.

Preferentially, the optical element comprises at least one input surface and at least one output surface provided with a focus, said input surface being situated substantially in a plane including said focus.

Advantageously, the first position is to the left of the optical axis of said portion and the second position is to the right of the optical axis of said portion at the level of the input surface of the optical element.

Advantageously, the two positions of the light source are defined in a vicinity of the focus of the outer surface.

Preferentially, the distance between the two positions is substantially equal to F tan (1.3°), F being the thickness of the corresponding elementary portion.

Advantageously, the orientation of the light source in the first position is between 10° and 45°, preferentially between 15° and 30°, notably equal to 15°, relative to a horizontal axis and the orientation of the source in the second position is between −10° and −45°, preferentially between −15° and −30°, notably equal to −15°, relative to a horizontal axis.

Preferentially, the light source consists of a light-emitting semiconductor chip, for example a light-emitting diode.

Advantageously, the light source is a light-emitting diode comprising at least one photoemissive element in which the orientation of the edges of the photoemissive element depends on the angle of the oblique cut-off.

Preferentially, the optical portion is a lens.

Advantageously, the material of the optical portion is PVC, glass, polycarbonate or PMMA (polymethyl methacrylate) or even silicone.

Advantageously, the outer surface of the optical portion is substantially a portion of ellipsoid.

Preferentially, the portion of ellipsoid is obtained by deforming an ellipsoid of revolution homothetically relative to a plane in order to generate a beam with oblique cut-off to the right in the first position and a beam with oblique cut-off to the left in the second position.

Advantageously, the optical module further comprises a substrate, which substrate has at least one surface intended to receive a light source.

Another subject of the invention is a light headlight for motor vehicle comprising at least one optical module according to the invention.

Advantageously, a light headlight according to the invention comprises:

a housing intended to be fixed to a vehicle, an outer lens closing said housing, said light headlight (1) being housed inside the space delimited by the housing and the closing outer lens, the light headlight being arranged in such a way that the rays outgoing from said output surface directly reach said closing outer lens.

Preferentially, the rays emitted by the module at the output of the global output surface of the module form a portion or all of a road lighting, signaling or vehicle interior lighting beam.

According to different embodiments of the invention which will be able to be taken together or separately:

- the body of the optical element is divided into five solid elementary portions, each characterized by an input surface and by an output surface,
- the five output surfaces are contiguous, to form a global output surface of the optical element, which is continuous, the five input surfaces are separated from one another, and are substantially aligned with the two lugs, the three intermediate elementary portions each have two walls emerging from the input surface and extending toward two edges delimiting the output surface of the same portion, these walls for example being able to be aluminized, they are intended to prevent the beams produced by a light source placed at the level of an input surface of a portion from passing through the output surface of an adjacent portion, the two end elementary portions have only a single wall intended to prevent a light source placed at the level of the input surface of one of them, from irradiating an output surface of an adjacent elementary portion, since each of the end portions has only a single adjacent elementary portion, the walls of two adjacent elementary portions are joined by means of a curved wall segment the light beam can be broken down into several components each deriving from an elementary portion of the module associated with the corresponding LED, the end elementary portion situated to the left of the module and associated with the corresponding end LED, can be used to produce a lighting to the left focused on range, this lighting being more concentrated and intense, the left intermediate elementary portion, associated with the corresponding LED, can be used to produce a lighting horizontally extended to the left, this lighting being rather less intense and spread transversely relative to the vehicle, the central intermediate elementary portion, associated with the corresponding LED, can be used to produce a lighting extended horizontally as much to the right as to the left, this lighting being rather less intense and spread transversely relative to the vehicle the right intermediate elementary portion, associated with the corresponding LED, can be used to produce a lighting extended horizontally to the right, this lighting being rather less intense and spread transversely relative to the vehicle, the end elementary portion is dedicated to producing a lighting comprising an oblique cut-off compatible with traffic driving on the right and traffic driving on the left.

The invention will be better understood in light of the following description which is given purely in an indicative manner and whose aim is not to limit it, accompanied by the attached drawings in which.

Figure 2:
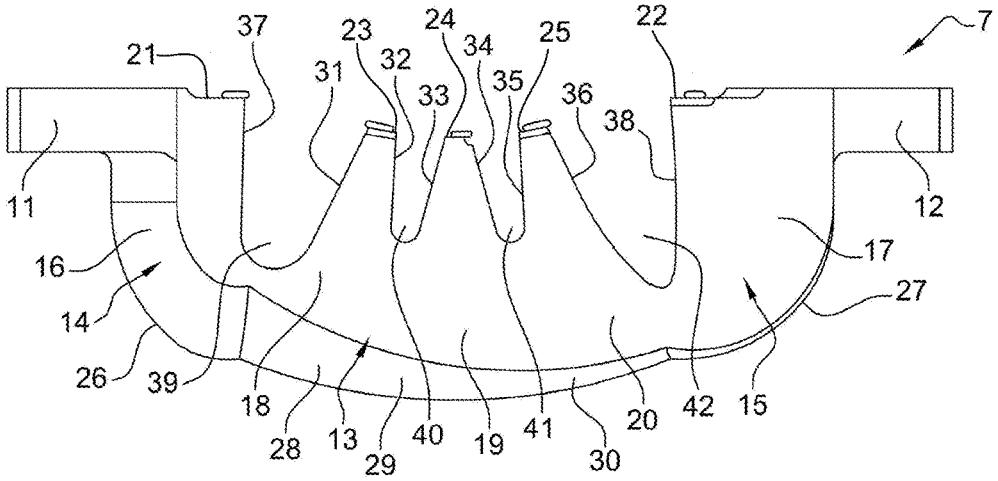
FIG. 2 is a plan view of an optical element according to the invention.
Figure 3A:
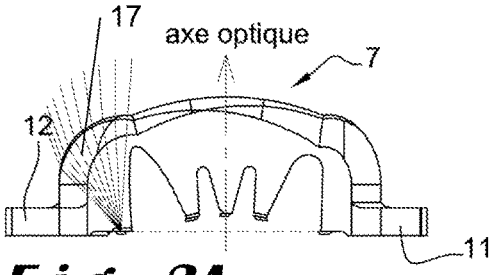
Figure 3B:
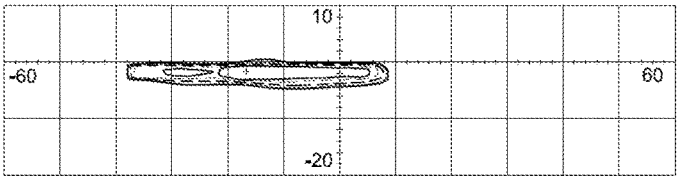
Figure 4A:
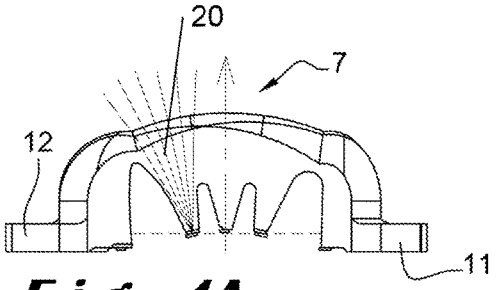
Figure 4B:
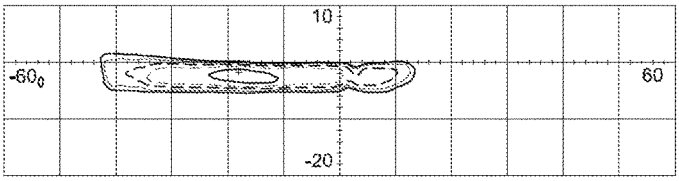
Figure 5A:
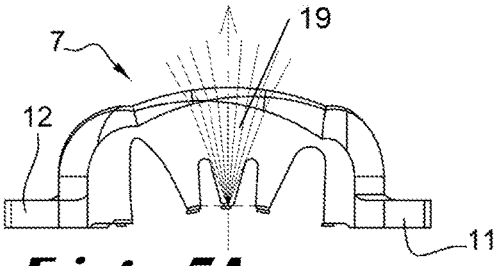
Figure 5B:
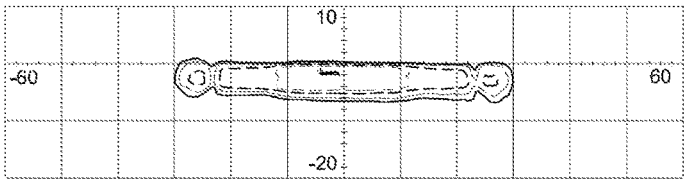
Figure 6A:
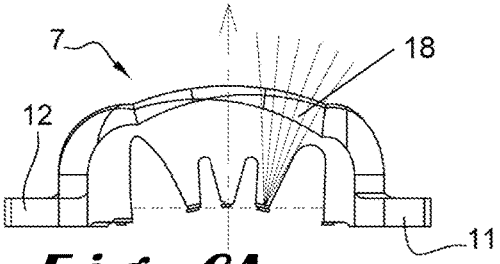
Figure 6B:
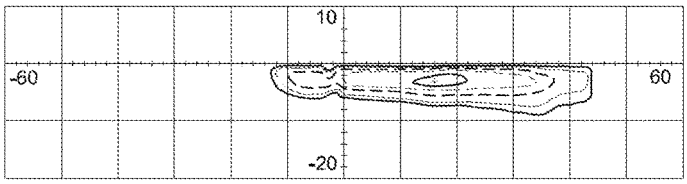
Figure 7:
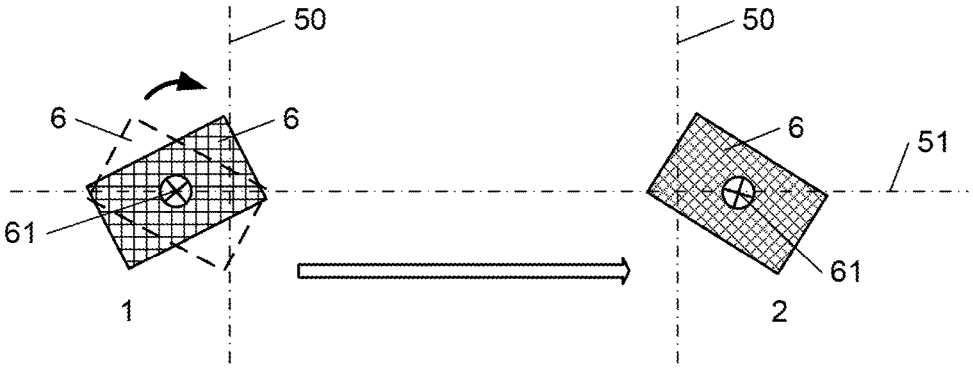
Figure 8:
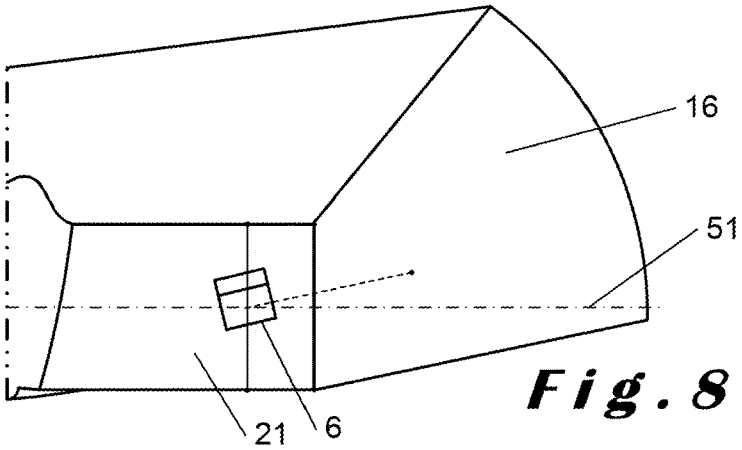
Figure 9A:
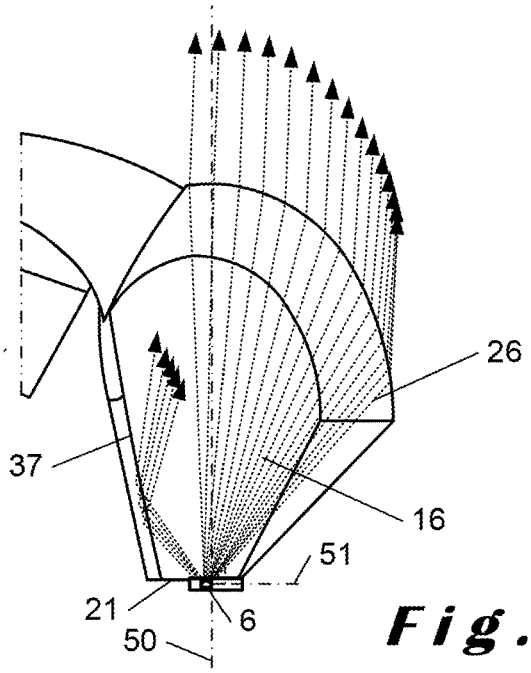
Figure 9B:
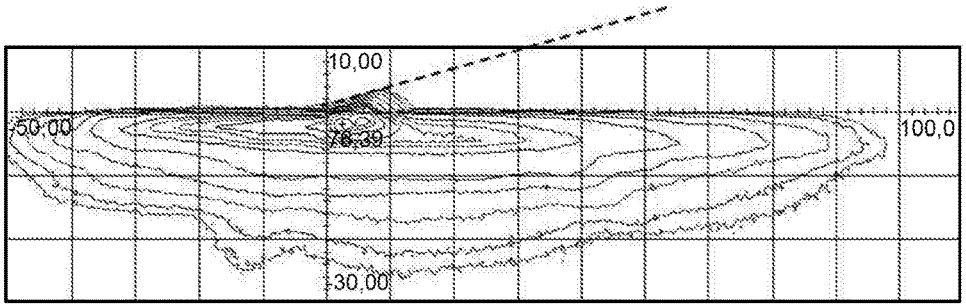
Figure 10:
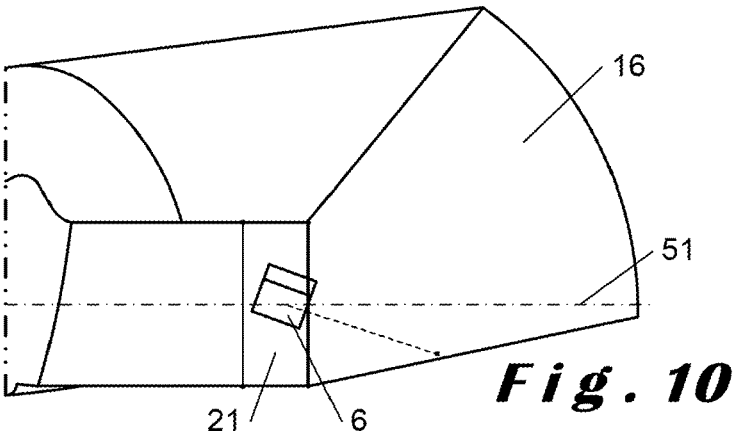
Figure 11A:
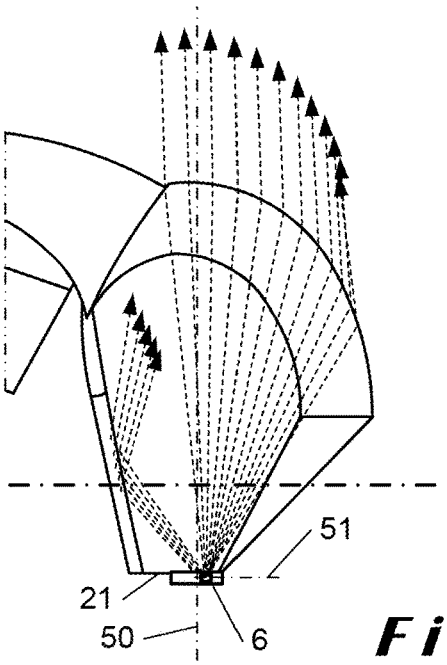
Figure 11B:
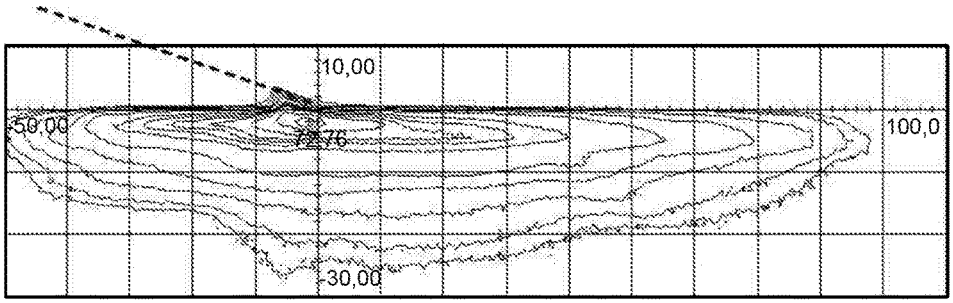
Figure 12:
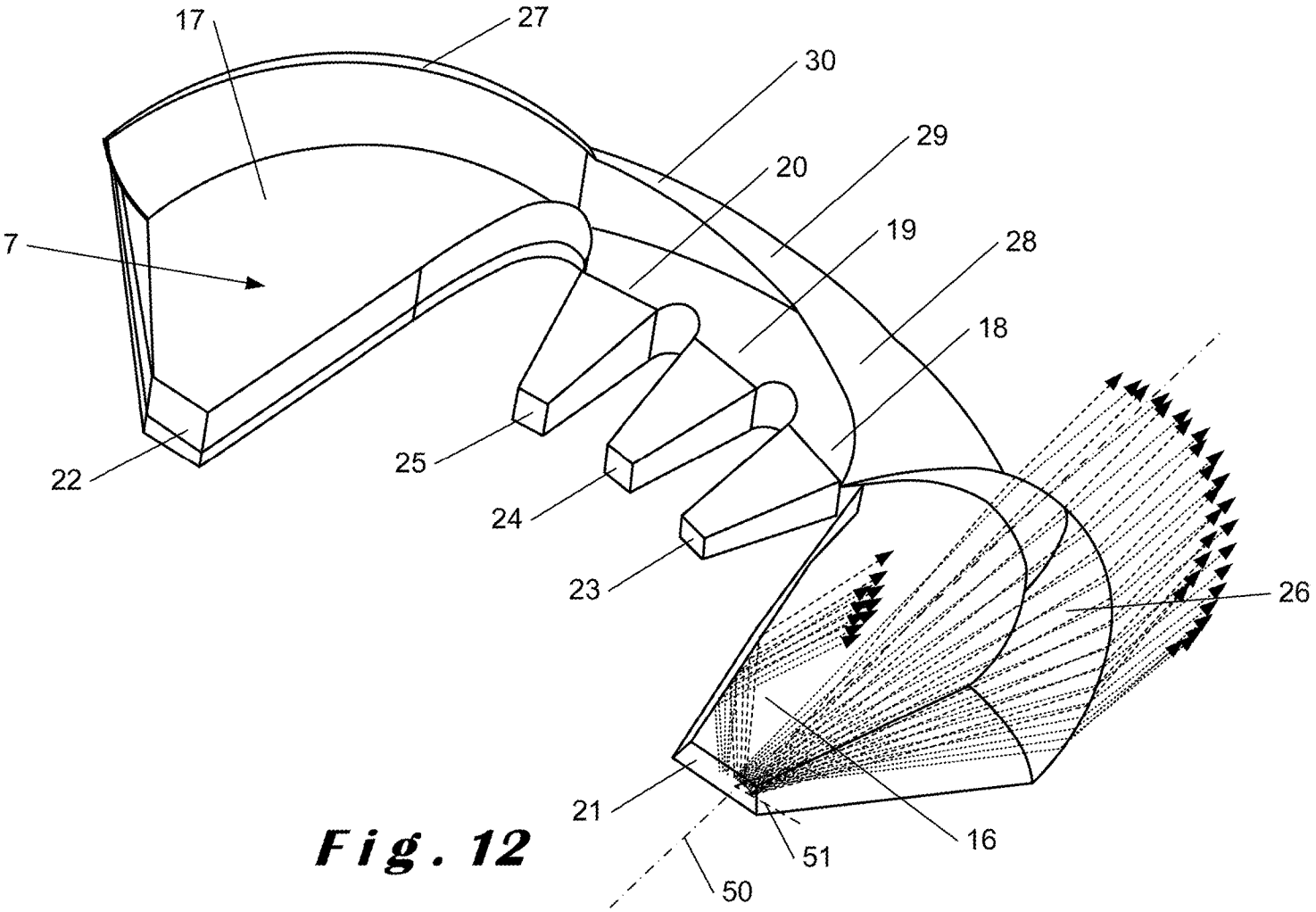

FIG. 3A is a view similar to FIG. 2, illustrating an example of trajectory of light beams from a first diode of a light module according to the invention, FIG. 3B is an isolux diagram of the light beam produced by the first diode of FIG. 3A, FIG. 4A is a view similar to FIG. 2, illustrating an example of trajectory of light beams from a second diode of a light module according to the invention, FIG. 4B is an isolux diagram of a light beam produced by the second diode of FIG. 4A, FIG. 5A is a view similar to FIG. 2, illustrating an example of trajectory of light beams from a third diode of a light module according to the invention, FIG. 5B is an isolux diagram of the light beam produced by the third diode of FIG. 5A, FIG. 6A is a view similar to FIG. 2, illustrating an example of trajectory of light beams from a fourth diode of a light module according to the invention, FIG. 6B is an isolux diagram of the light beam produced by the fourth diode of FIG. 6A, FIG. 7 illustrates the rotation and the translation of a light source between two possible positions, FIG. 8 is a rear view of a portion of the optical element, FIG. 9A is a partial perspective view of the optical element, illustrating an example of trajectory of light beams from a first position occupied by a fifth diode of a light module according to the invention, FIG. 9B is an isolux diagram of the light beam produced by all of the optical module and of which the fifth diode is in a position according to FIG. 8, FIG. 10 is a rear view of a portion of the optical element, FIG. 11A is a partial perspective view of the optical element, illustrating an example of trajectory of light beams from a second position occupied by a fifth diode of a light module according to the invention, FIG. 11B is an isolux diagram of the light beam produced by all of the optical module and of which the fifth diode is in a position according to FIG. 10, FIG. 12 is a perspective view of a light module, illustrating an example of trajectory of light beams from a fifth diode for two distinct positions of a light module according to the invention.

Figure 1:
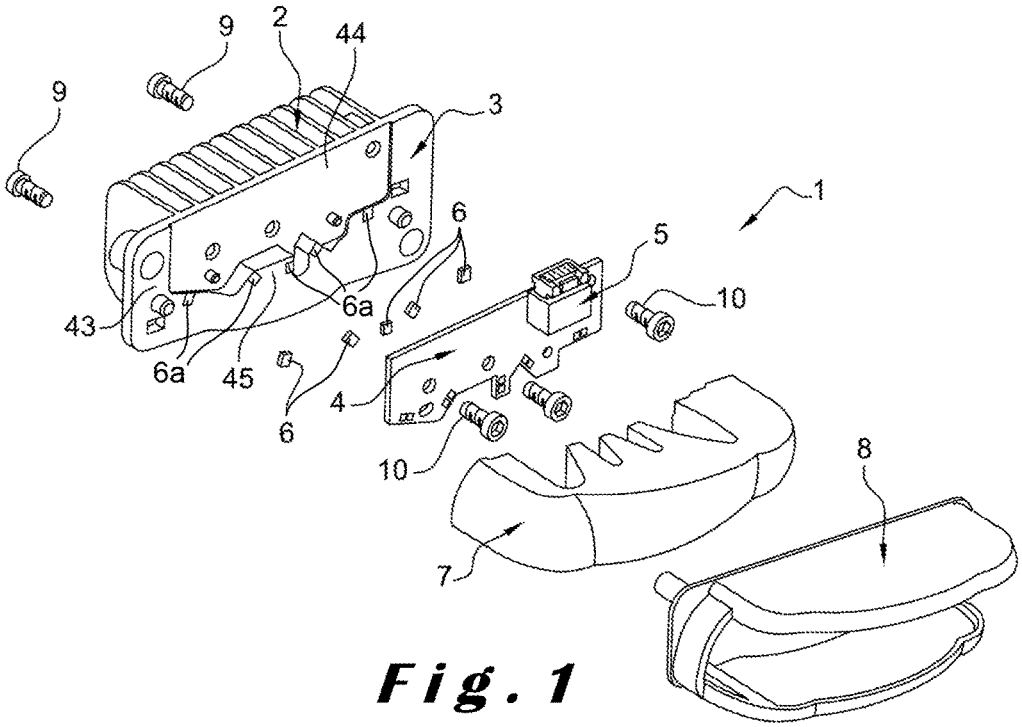
FIG. 1 is an exploded view of a light module according to the invention.

Referring to FIG. 1, a light module 1 according to the invention comprises a heatsink 2 linked to a substrate 3, an electronic circuit board 4, of the printed circuit board type, provided with an electrical connector 5, five light-emitting diodes 6 which are called LEDs hereinbelow in the description, an optical element 7 made of transparent material according to the invention and a protection and securing housing 8, capable of gripping the optical element 7. The housing 8 is for example fixed to the substrate 3 by means of a first series of screws 9. The electronic circuit board 4 is for example anchored in the substrate 3 by means of a second series of screws 10. The substrate 3 further comprises five locations **6*a* intended for positioning the diodes 6. Such a module 1** is intended to be fixed, for example, inside a vehicle headlight.

Referring to FIG. 2, the optical element 7 made of transparent material according to the invention is solid and is produced for example in PMMA (polymethyl methacrylate), and acts as an optical lens. This optical element schematically comprises two lateral lugs 11, 12 and a central body 13 situated between the lugs 11, 12. The body 13 is edged by two end arms 14, 15, each linked to a lug 11, 12, each of the arms 14, 15 extending in a direction which is at right angles to that of the lug 11, 12 to which it is connected. The two lugs 11, 12 are strictly aligned, so that the optical element 7 can come to bear against a planar surface, via its lugs 11, 12. The body 13 of this optical element 7 is divided up into five solid elementary portions 16, 17, 18, 19, 20, each characterized by an input surface 21, 22, 23, 24, 25 and by an output surface 26, 27, 28, 29, 30. This optical element 7 thus has two end elementary portions 16, 17, forming the two end arms 14, 15, and three intermediate elementary portions 18, 19, 20 positioned between the end portions 16, 17. The five output surfaces 26, 27, 28, 29, 30 are contiguous, to form a global output surface of the optical element 7, which is continuous. The five input surfaces 21, 22, 23, 24, 25 are separated from one another, and are substantially aligned with the two lugs 11, 12. Each portion 16, 17, 18, 19, 20 is elongate, the input surface 21, 22, 23, 24, 25 and the output surface 26, 27, 28, 29, 30 constituting the two ends of each of the portions 16, 17, 18, 19, 20 along their longitudinal axis. The three intermediate elementary portions 18, 19, 20 each have two walls 31, 32, 33, 34, 35, 36 emerging from the input surface 23, 24, 25 and extending toward two edges delimiting the output surface 28, 29, 30 of the same portion 18, 19, 20. These walls 31, 32, 33, 34, 35, 36, which can for example be aluminized, are intended to prevent the beams produced by a light source placed at the level of an input surface 23, 24, 25 of a portion 18, 19, 20, from passing through the output surface of an adjacent portion. The two end elementary portions 16, 17 have only a single wall 37, 38 intended to prevent a light source placed at the level of the input surface 21, 22, of one of them, from irradiating an output surface of an adjacent elementary portion, since each of the end portions 16, 17 has only a single adjacent elementary portion. The walls 31, 32, 33, 34, 35, 36, 37, 38 of two adjacent elementary portions 16, 17, 18, 19, 20 are joined by means of a curved wall segment. The optical element 7 thus has a series of four hollows 39, 40, 41, 42 arranged alternately with the five elementary portions 16, 17, 18, 19, 20, each hollow thus being delimited by a wall of an elementary portion and by a wall of an adjacent elementary portion. The two input surfaces 21, 22 of the two end elementary portions 16, 17 are situated setback from the input surfaces 23, 24, 25 of the three intermediate elementary portions 18, 19, 20. For each of the five elementary portions 16, 17, 18, 19, 20, the average distance separating the input surface and the output surface is substantially constant. The input surfaces 21, 22, 23, 24, 25 are planar and the output surfaces 26, 27, 28, 29, 30 are of rounded form.

Preferably, each output surface (26, 27, 28, 29, 30) of a portion (16, 17, 18, 19, 20) allows a focus which is situated substantially at the level of the corresponding input surface (21, 22, 23, 24, 25). The form of each output surface is substantially that of an ellipsoid portion.

The fact that the focus of each output surface is located at the level of the input surface of the same portion means that there is a point or a segment, horizontal or inclined, in the vicinity of the input surface such that a majority of rays from this point or from the points of the line re-emerge from the output surface parallel to one and the same plane.

Referring to FIG. 1, the heatsink 2 and the substrate 3 constitute a one-piece optical element preferably made of metal. The substrate 3 can be likened to a plate of small thickness having an implantation face 43 provided with a void 44 whose outline is similar to that of the electronic circuit board 4, the void 44 being intended to receive the board 4. This face 43 has a central protuberance 45 partially edging the void 44 and contributing to partially enlarge the edge defining the void 44.

Referring to FIG. 1, the five LEDs 6 are secured to the face 43 of the substrate 3, which is provided with the void 44, in a zone outside the void 44.

More specifically, referring to FIG. 1, the five LEDs 6 are arranged along the edge delimiting the void 44, three LEDs 6 being placed on the protuberance 45 and the other two LEDs 6 being placed at the level of the face 43 of the substrate 3 situated at a lower altitude than that of the protuberance 45. In this way, two end LEDs 6 frame three raised intermediate LEDs 6. Each LED 6 has a photoemissive element of substantially square form and having a small thickness.

The five LEDs 6 are turned differently relative to the forward direction, i.e. the direction of emission of the module. In other words, seen from the front, these LEDs have different orientations. For example, in projection onto a projection plane situated in front of the LEDs and at right angles to the optical axis of emission of the light module, these LEDs have different orientations within the projection plane. Thus, two LEDs can be arranged in such a way that the edges of their photoemissive elements have, seen from the front, a different orientation. These edges can, seen from the front, form between them an angle of 45°. This angle makes it possible to reduce the thickness of the beam, the beam being thicker when the LED is vertical and thinner when it is horizontal. An angle of 45° between the edges of the photoemissive elements of the two LEDs also enhances the homogeneity of the beam, without in any way modifying its light distribution which is still horizontal. These five LEDs 6 are arranged to emit a light beam in the same direction.

As illustrated in FIG. 1, the optical element 7 according to the invention is fixed onto the substrate 3 in such a way that each of the five LEDs 6, secured to the substrate 3, comes to be positioned at the level of an input surface 21, 22, 23, 24, 25 of the optical element 7, illustrated in FIG. 2, such that each LED 6 can send a light beam toward the input surface 21, 22, 23, 24, 25 with which it is associated, the beams passing through the input surface 21, 22, 23, 24, 25 to then pass through the output surface 26, 27, 28, 29, 30 of the same portion. Thus, the light beams from each input surface 21, 22, 23, 24, 25 can, either directly arrive at the corresponding output surface 26, 27, 28, 29, 30, or be previously reflected on the walls 31, 32, 33, 34, 35, 36, 37, 38 before arriving on the output surface. The walls 31, 32, 33, 34, 35, 36, 37, 38 prevent the light beams emitted by an LED 6 placed at the level of an elementary portion 16, 17, 18, 19, 20 from arriving at the output surface 26, 27, 28, 29, 30 of an adjacent elementary portion. The elementary portions 16, 17, 18, 19, 20 act separately and autonomously in order to obtain a resultant light beam, with no stray interferences.

FIGS. 3A to 6B illustrate an example of use of a light module 1 according to the invention, by breaking down the resultant light beam into several components each from an elementary portion 17, 18, 19, 20 of the module 1 associated with the corresponding LED 6. The light beam originating from the end elementary portion 16 is illustrated in FIGS. 9A, 9B and 11A, 11B.

In this way referring to FIGS. 3A and 3B, the end elementary portion 17 situated on the left of the module 1 and associated with the corresponding end LED 6 can be used to produce a lighting to the left focused on range. This lighting is more concentrated and intense.

Referring to FIGS. 4A and 4B, the left intermediate elementary portion 20, associated with the corresponding LED 6, can be used to produce a lighting extended horizontally to the left. This lighting is rather less intense and spread transversely relative to the vehicle.

Referring to FIGS. 5A and 5B, the central intermediate elementary portion 19, associated with the corresponding LED 6, can be used to produce a lighting extended horizontally as much to the right as to the left. This lighting is rather less intense and spread transversely relative to the vehicle.

Referring to FIGS. 6A and 6B, the right intermediate elementary portion 18, associated with the corresponding LED 6, can be used to produce a lighting extended horizontally to the right. This lighting is rather less intense and spread transversely relative to the vehicle.

The lightings generated by the portions 17, 18, 19 and 20 are extended horizontally. They are dedicated to illuminating the road in front of the driver. The latter can notably be used to generate a part of the lighting required by low beams of a vehicle. The different lighting distributions illustrated in FIGS. 3B to 6B show that these components include a horizontal cut-off, that is to say that there is no lighting beyond the line indicating the horizontal on the isolux diagrams of the light beam.

The low beams generally also include a component having an oblique cut-off in order to illuminate the signs situated on the side of the road, and the sidewalks or the verges. This oblique cut-off forms an angle with the horizontal cut-off of the other components illustrated in FIGS. 3B to 6B. The angle formed by this oblique cut-off is preferentially +15 degrees (oblique part to the right of the beam, raised upward) for cars designed for traffic driving on the right, and this angle is preferentially −15 degrees (oblique part to the left of the beam, raised upward) for cars designed for traffic driving on the left.

The end elementary portion 16 is dedicated to producing a lighting comprising an oblique cut-off compatible with traffic driving on the right and traffic driving on the left.

The input surface 21 of the elementary portion 16 comprises two distinct positions to have an LED intended to generate a lighting comprising the oblique cut-off. Each of the two positions is defined on either side of the optical axis of the elementary portion 16. It is the position of the source in relation to the optical axis which determines the direction of propagation of the rays. In the first position, the LED generates a lighting with oblique cut-off to the right, and in the second position, the LED generates a lighting with oblique cut-off to the left. This is an intense lighting focused on range.

FIG. 7 illustrates the change of position of the LED 6 to switch from the first position to the second position. The optical axis of the elementary portion 16 is at right angles to the lines 50 and 51, so as to be at right angles to the LED 6. The photoemissive element of the LED 6 first undergoes a rotation about its axis 61 (the line of the axis, coinciding with the center of the LED, is identified by 61) in order to correctly orient the distribution of the beam on the road according to the traffic. It then undergoes a translation to the right in order for the beam to be propagated to the left. In the first position, the center of the LED 61 is positioned to the left of the optical axis 50 to the left of the optical axis, at a distance which is F tan (1.3°) therefrom, where F is the thickness of the elementary portion 16.

The photoemissive element of the LED is inclined relative to the horizontal axis 51. Preferably, the photoemissive element forms an angle of 15 degrees with the horizontal. Preferably, the amplitude of the rotation to switch from the first position to the second position is 150° in order for the angle formed by the edges of the photoemissive element with the horizontal 51 to be −15°. Finally, to arrive in the second position, the LED undergoes a translation in order for its center to be located to the right of the optical axis of the elementary portion 16.

The two positions make it possible to obtain beams with oblique cut-off that are substantially symmetrical.

These two positions are situated in the vicinity of the focus of the outer surface 26. The first position is substantially offset to the left of the focus and the second position is substantially offset to the right of the focus. The fact that the two positions are close to one another ensures that the optical module is compact.

The form of the output surface 26 of the elementary portion 16 makes it possible to obtain the two beams with oblique cut-off respectively to the right and to the left for each of the positions of the LED. The form of the output surface 26 is substantially that of an ellipsoid. Ray plotting software makes it possible to determine the modifications that have to be made to the ellipsoid of revolution in order to generate the beams with oblique cut-off corresponding to each of the positions. The ellipsoid of revolution is deformed homothetically relative to a plane in order to generate a beam with oblique cut-off to the right in the first position and a beam with oblique cut-off to the left in the second position. The deformation of the surface is performed relative to a direction at right angles to a plane, which is obtained by:

- a rotation of 20° in the counter-clockwise direction of the vertical plane about the optical axis of the optical portion 16,
- a translation of this plane relative to the focus of the optical portion to the right.

FIG. 8 is a rear view of the elementary portion 16 with the LED 6 in the first position. The LED 6 is positioned on the input surface 21 to the left of the optical axis (not drawn in the figure). It is inclined by an angle of 15 degrees relative to the horizontal axis 51.

FIG. 9A illustrates the trajectory of the light rays from the fifth diode 6 when the latter is located in the first position on the input surface 21. The diode is positioned to the left of the optical axis 50 and the beam is propagated to the right thereof. A part of the beam is reflected on the wall 37. The distribution of the lighting is illustrated in FIG. 9B. The beam comprises an oblique cut-off to the right. The angle of the cut-off is 15° relative to the horizontal.

FIG. 10 is a rear view of the portion 16 with the LED 6 in the second position. The LED 6 is positioned on the input surface 21 to the right of the optical axis (not drawn in the figure). It is inclined by an angle of −15 degrees relative to the horizontal axis 51.

FIG. 11A illustrates the trajectory of the light beams from the fifth diode when the latter is located in the second position on the input surface 21. The diode is positioned to the right of the optical axis 50 and the beam is propagated to the left thereof. A part of the beam is also reflected on the wall 37. The distribution of the lighting is illustrated in FIG. 11B. The beam comprises an oblique cut-off to the left in which the angle of the cut-off is −15° relative to the horizontal.

Referring to FIG. 12, the optical element 7 is illustrated with the propagation of the light beam in the portion 16 at the right end simultaneously for the two positions of the diode. The beam illustrated by dotted lines originates from the first position of the diode. The beam is propagated to the right in order to generate a lighting with oblique cut-off to the right. Conversely, the beam illustrated by dashes originates from the LED when it is located in the second position, to the right of the optical axis. The beam is propagated to the left in order to generate a lighting with oblique cut-off to the left.

In this way, an identical mold will be used to produce the optical element 7 according to the invention. Only the position of the LEDs changes according to the type of traffic to which the motor vehicle will be subject. Now, as described previously, the five LEDs 6 are secured to the face 43 of the substrate 3. It is consequently sufficient to produce two types of substrates with LED positions suited to the type of traffic.

As FIGS. 3A, 4A, 5A, 6A, 9A and 11A clearly show, the light beams produced by each LED 6 of the light module 1 pass only through the elementary portion 16, 17, 18, 19, 20 with which the LED 6 is associated, without being able to be propagated to the output surface 26, 27, 28, 29, 30 of an adjacent elementary portion 16, 17, 18, 19, 20. It follows therefrom that a light module 1 according to the invention is capable of producing a resultant light beam, which is sharp and precise, because it is devoid of all stray light beams due to light interferences between the different elementary portions 16, 17, 18, 19, 20 of the module 1.

Although the LEDs all bear the same reference in the description, in this case the digit 6, they can naturally have different structural, geometric and light characteristics within one and the same light module 1, the LEDs 6 being chosen according to the specific lighting needs.

Preferentially, the optical source is a light-emitting semiconductor chip, for example a light-emitting diode. Such a diode offers a good light beam quality, while remaining small. It is therefore perfectly suited to a light module according to the invention, whose dimensions have to be limited to be able, for example, to be incorporated in a motor vehicle.

The type of source used in the present invention is not however limited to that of a light-emitting diode. The source can also be an incandescent lamp, a discharge lamp, a laser source, or any type of source making it possible to generate a beam having properties similar to the properties described above.

Although the lighting device according to the invention has been described in the context of a device comprising a plurality of optical portions, making it possible to generate all of the components required by the low beams, this lighting device can also comprise only the end elementary portion 16. This elementary portion 16, when isolated, thus forms a separate optical module.

The headlight manufacturer now only has to design a single optical element, with single manufacturing toolages (molds for example), making it possible to manufacture a single optical module compatible with the different types of traffic. Given that it is the position of the light sources relative to the end elementary portion 16 which determines the type of beam with oblique cut-off, the headlight manufacturer can design two models of substrates 3 on which the light sources are positioned, one being designed for traffic driving on the left and the second being designed for traffic driving on the right.

The optical module according to the invention has a compact geometry, and consequently has little bulk.

Preferentially, the rays emitted by the module at the output of the output surface of the module form a portion or all of a road lighting, signaling or vehicle interior lighting beam. In this way, it is pointless to fit another optical deflection element or a cover. In other words, the light device can be devoid of lens, of reflector or of cover after the output surface.

Although the light device according to the invention has been described in the context of a beam with oblique cut-off, this device can also be adapted to other types of beams with oblique cut-off, requiring a same optic and different positions of light sources to generate respective light beams compatible with different types of regulations. Also, the light module according to the invention can be a lighting and/or signaling module.

The invention claimed is:

1. A light module for a motor vehicle comprising:

an optical element configured to generate a beam with a partly oblique cut-off, the optical element comprising at least one optical portion having an optical axis and a fixed relation to the optical element, and at least one light source configured to cooperate with the at least one optical portion configured to generate at least the part of the beam comprising the oblique cut-off, wherein the at least one optical portion accommodates the at least one light source between any of at least two distinct positions of the at least one optical portion, the at least one light source occupying one of the at least two distinct positions, each of the positions being defined on either side of the optical axis of the at least one optical portion so as to generate a beam with oblique cut-off to a right in a first position and a beam with oblique cut-off to a left in a second position.

2. The light module according to claim 1, wherein the optical element comprises at least one input surface and at least one output surface provided with a focus, said input surface being situated substantially in a plane including said focus.

3. The light module according to claim 2, wherein the at least two distinct positions of the light source are defined in a vicinity of the focus of the output surface.

4. The light module according to claim 1, wherein the first position is to the left of the optical axis of said at least one optical portion and the second position is to the right of the optical axis of said at least one optical portion at a level of an input surface of the optical element.

5. The light module according to claim 1, wherein a distance between the at least two distinct positions is substantially F tan (1.3°), F being a thickness of a corresponding optical portion.

6. The light module according to claim 1, wherein an orientation of the at least one light source in the first position is between 10° and 45° relative to a horizontal axis and an orientation of the at least one light source in the second position is between −10° and −45° relative to the horizontal axis.

7. The light module according to claim 1, wherein the at least one light source consists of a light-emitting semiconductor chip.

8. The light module according to claim 7, wherein the at least one light source is a light-emitting diode comprising at least one photoemissive element in which an orientation of edges of the photoemissive element depends on an angle of the oblique cut-off.

9. The light module according to claim 1, wherein the at least one optical portion is a lens.

10. The light module according to claim 1, wherein an output surface of the at least one optical portion is substantially a portion of an ellipsoid.

11. The light module according to claim 10, wherein the portion of an ellipsoid is obtained by deforming an ellipsoid of revolution, homothetically relative to a plane in order to generate a beam with oblique cut-off to the right in the first position and a beam with oblique cut-off to the left in the second position.

12. The light module according to claim 1, further comprising a substrate, wherein the substrate has at least one surface to receive the at least one light source.

13. A light headlight for a motor vehicle comprising at least one light module according to claim 1.

14. The light headlight according to claim 13, further comprising:

a housing to be fixed to the vehicle, an outer lens closing said housing, said light module being housed inside a space delimited by the housing and the outer lens, the light headlight being arranged in such a way that rays outgoing from an output surface of the optical module reach said outer lens.

15. The vehicle light headlight according to claim 13, wherein rays emitted by the light module at an output of an output surface of the light module form a portion or all of a road lighting, signaling or vehicle interior lighting beam.

16. The light module according to claim 2, wherein the first position is to the left of the optical axis of said at least one optical portion and the second position is to the right of the optical axis of said at least one optical portion at a level of an input surface of the optical element.

17. The light module according to claim 2, wherein a distance between the at least two distinct positions is substantially F tan (1.3°), F being the thickness of the corresponding optical portion.

18. The light module according to claim 2, wherein an orientation of the at least one light source in the first position is between 10° and 45° relative to a horizontal axis and an orientation of the at least one light source in the second position is between −10° and −45° relative to the horizontal axis.

19. The light module according to claim 2, wherein the at least one light source consists of a light-emitting semiconductor chip.

20. The light module according to claim 2, wherein the optical portion is a lens.

* * * * *